US005491859A

United States Patent [19]

Richardson

[11] Patent Number: 5,491,859

[45] Date of Patent: Feb. 20, 1996

[54] DRIVE SYSTEM FOR AUTOMATIC WASHING MACHINE

[75] Inventor: Curtis G. Richardson, Energy, Ill.

[73] Assignee: Maytag Corporation, Newton, Iowa

[21] Appl. No.: 159,259

[22] Filed: Nov. 30, 1993

[51] Int. Cl.[6] ..... D06F 37/40

[52] U.S. Cl. ..... 8/159; 68/23.7; 68/23.3; 68/133

[58] Field of Search ..... 68/23.7, 133, 23.3; 74/79, 48; 8/159

[56] References Cited

U.S. PATENT DOCUMENTS

| | | | |
|---|---|---|---|
| 1,886,888 | 11/1932 | Kirby . | |
| 2,269,190 | 1/1942 | Dunham . | |
| 2,512,847 | 6/1950 | Conterman . | |
| 2,807,951 | 10/1957 | Gernardt et al. | 68/23.7 |
| 2,841,260 | 7/1958 | Lodge . | |
| 2,845,156 | 7/1958 | Dayton | 68/23.7 |
| 2,930,215 | 3/1960 | Smith | 68/23.7 |
| 2,976,746 | 3/1961 | Flannery | 68/23.7 |
| 3,314,257 | 4/1967 | Fosler et al. . | |
| 3,490,569 | 1/1970 | Reed . | |
| 3,838,755 | 10/1974 | Cochran et al. . | |
| 3,845,642 | 11/1974 | Cochran | 68/23.7 |
| 3,872,694 | 3/1975 | Sikamori et al. . | |
| 4,076,437 | 2/1978 | Mazzolla . | |
| 4,152,953 | 5/1979 | Headley . | |
| 4,255,952 | 3/1981 | Johnson | 68/23.7 |
| 4,395,890 | 8/1983 | Goodlayson | 74/48 |
| 4,476,736 | 10/1984 | Hershberger | 68/23.7 |
| 4,718,258 | 1/1988 | Mason et al. . | |
| 4,803,855 | 2/1989 | Kennedy . | |
| 4,890,465 | 1/1990 | Burk et al. | 68/23.7 |
| 5,033,278 | 7/1991 | Hossfield et al. | 68/23.7 |
| 5,379,616 | 1/1995 | Bae | 68/23.7 |

FOREIGN PATENT DOCUMENTS

| | | | |
|---|---|---|---|
| 62-172995 | 7/1987 | Japan | 68/23.7 |

*Primary Examiner*—Frankie L. Stinson
*Attorney, Agent, or Firm*—Bacon & Thomas

[57] ABSTRACT

A drive system for producing agitation and spin in an automatic washing machine incorporates a transmission assembly including a plurality of interengaged transmission elements located within a transmission housing. During agitation, the transmission housing is braked and the transmission elements convert input rotary drive from a motor to oscillator drive of an output shaft. During spin, a cam member carried by one of the transmission elements automatically shifts a stop element into engagement with the transmission housing. This maintains the transmission elements in a predetermined orientation, prevents relative rotation between each of the transmission elements and the transmission housing and causes the entire transmission assembly to rotate in unison which results in rotation of the output shaft. Since the transmission elements are maintained in the same predetermined orientation during each spin, the entire transmission assembly can be effectively counterbalanced to minimize unbalancing of the system and reduce vibrations during operation.

13 Claims, 6 Drawing Sheets

DRIVE SYSTEM FOR AUTOMATIC WASHING MACHINE

BACKGROUND OF THE INVENTION

1. Field of the Invention

The present invention pertains to automatic washing machines and, more particularly, to a drive system for use in an automatic washing machine.

2. Description of the Prior Art

It is widely known in the art of automatic washing machines to provide a drive system for producing both spin and agitation in a cycle of operation. During a typical spin portion of the cycle, a washing machine basket, containing a generally unevenly distributed load of wet clothes, is rotated at a high rate of speed. This rotation develops centrifugal forces resulting in a certain degree of drying of the clothes. Rotation of the washing machine basket can be accompanied by a considerable amount of vibration, not only of the clothes basket itself but also the entire automatic washing machine, if the rotating elements are not properly counterbalanced. Many systems have been employed for the purpose of reducing vibration of the washing machine basket and/or preventing the vibration from being transmitted to the supporting structure. Commercial washing machines can be readily constructed of heavy parts to overcome any uneven load distribution in the washing machine basket so as to minimize or prevent any vibration of the machine as a whole. The inclusion of heavy supporting parts for a domestic machine is objectionable since machines must be readily transportable and are generally of standard sizes.

A typical spin portion of a cycle of operation is effected by rotating the clothes basket by means of a motor driven transmission assembly so that during the spin, the transmission assembly is also rotated at a high rate of speed. The transmission assembly is rather heavy as compared to the washing machine basket itself and therefore can considerably affect the balancing of the washing machine during spin. Therefore, it is extremely important to the overall vibration dampening of the washing machine during operation to properly counterbalance the transmission assembly during spin. Unfortunately, such transmission assemblies generally include a plurality of interengaged transmission elements that vary in position during operation of the washing machine. Due to the considerable weight of each of these elements, their respective positions during any given spin cycle can greatly affect machine balancing.

It has heretobefore been known to maintain the plurality of elements of an automatic washing machine transmission assembly fixed relative to each other during spin while rotating the transmission assembly as a whole. In such known systems, the transmission elements have been braked at random locations and a balancing counterweight has been provided for the transmission assembly to minimize vibrations. According to such systems, the counterweight is sized and positioned for the average balancing location of the transmission assembly. Obviously, since the transmission elements in such an arrangement are randomly stopped, the counterweight cannot be accurately positioned throughout each spin.

Therefore, there exists a need in the art for a drive system for producing spin and agitation in a cycle of operation in an automatic washing machine wherein a transmission assembly of the drive system is accurately counterweighted so as to be properly balanced during spin in order to minimize developed vibrations.

SUMMARY OF THE INVENTION

It is an object of the invention to provide a drive system for an automatic washing machine including a transmission assembly that is adapted to rotate during the spin portion of a cycle of operation wherein the transmission assembly is effectively counterbalanced so as to minimize the development of vibrations during operation.

Briefly, the instant invention achieves these objects in a drive system for providing spin and agitating in the cycle of operation of an automatic washing machine. The drive system includes a bi-directional rotary input drive and an output drive. A transmission is drivingly interposed between the input drive and the output drive and includes a plurality of interconnected drive elements located within a transmission housing. Also provided is an apparatus for converting one direction of rotary input drive from the input drive to the transmission into oscillating drive of the output drive and converting the other direction of rotary input drive into uni-directional rotary output of the output shaft. The convening apparatus includes a mechanism for maintaining the plurality of interconnected drive elements in a predetermined orientation relative to the transmission housing whenever the input drive is rotated in the other direction.

Other objects, features and advantages of the invention will become more readily apparent from the following detailed description of preferred embodiments thereof when taken in conjunction with the drawings wherein like reference numerals refer to corresponding parts in the several views.

BRIEF DESCRIPTION OF THE DRAWINGS

FIG. 6(*b*) is a top view of the transmission assembly of FIG. 4 depicting an operational state thereof during both agitation and spin portions of the cycle of operation of the automatic washing machine.

FIG. 7(*b*) shows the positioning assembly of FIG. 7(*a*) in an agitation operating mode FIG. 8(*a*) depicts an element of the positioning assembly of FIG. 7(*a*).

FIG. 9(*b*) depicts the positioning assembly of FIG. 9(*a*) during agitation.

DETAILED DESCRIPTION OF THE PREFERRED EMBODIMENTS

Figure 1:
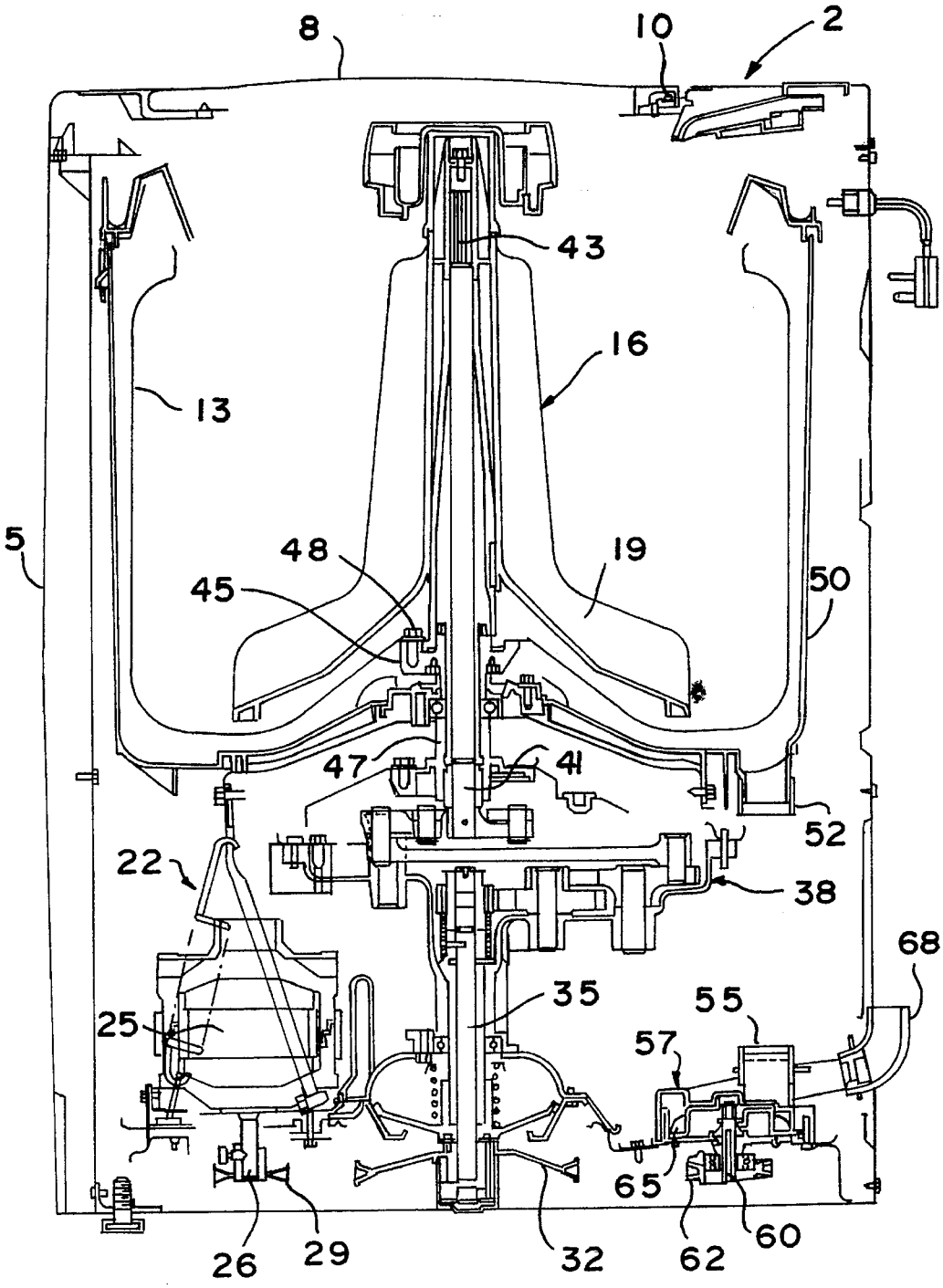
FIG. 1 is a partial, cross-section side view of an automatic washing machine incorporating the drive system of the invention.

The preferred embodiments of the invention will now be described in detail with initial reference to FIG. 1 which depicts an automatic washing machine 2 that includes an outer cabinet shell 5. Automatic washing machine 2 is provided with a lid 8 that is adapted to pivot about an axis 10 to provide access to a washing basket 13. As is widely known in the art, washing basket 13 is adapted to receive garments which undergo washing, rinsing and drying in a cycle of operation within automatic washing machine 2. Positioned within washing machine basket 13 is an agitator unit 16 having a plurality of blades 19 for use in agitating the garments placed within washing basket 13 during washing cycles.

During the cycle of operation, washing basket 13 and agitator unit 16 are adapted to be driven by a drive assembly, generally indicated at 22. Drive assembly 22 includes a bi-directional rotary motor 25 having an output drive shaft 26. A first pulley 29 is fixedly secured for rotation with output drive shaft 26 and is adapted to drive a second pulley 32 through a belt (not shown). Second pulley 32 is adapted to rotate an input drive shaft 35 of a transmission assembly 38. The specific connection between second pulley 32 and input drive shaft 35 will be described in detail hereinafter. Transmission assembly 38, which will be described in detail below, functions to transfer the input drive from motor 25, through input drive shaft 35, to an output drive shaft 41. Output drive shaft 41 is spline connected to agitator 16 at 43. Transmission assembly 38 is also adapted to drive a basket hub 45 through a transmission housing sleeve member 47. Washing basket 13 is fixedly secured to basket hub 45 for rotation therewith by a plurality of screws 48. The specific manner in which transmission assembly 38 oscillates agitating unit 16 and rotates washing basket 13, through basket hub 45 and transmission housing sleeve member 47, will be further detailed below.

Automatic washing machine 2 further includes an outer container 50 that is fixed relative to outer cabinet shell 5. Outer container 50 includes a discharge outlet 52 that is adapted to be connected to an inlet 55 of a pump 57 by a conduit (not shown). Pump 57 includes a shaft 60 that is fixedly secured to a third pulley 62 and also an impeller 65. Third pulley 62 is adapted to be driven by motor 25 through a belt (not shown) in a manner known in the art in order to draw liquid and/or detergents that flow into outer container 50 through washing basket 13 during predetermined cycle periods. Pump 57 creates a liquid flow therethrough which is discharged from automatic washing machine 2 through conduit 68.

Specific reference will now be made to FIGS. 2 and 3 in further detailing the structure of transmission assembly 38. Transmission assembly 38 includes a transmission housing 77 which is located within a fixed housing 80 disposed within outer cabinet shell 5. Transmission assembly 38 includes a plurality of interengaged transmission elements. In the preferred embodiment shown, these transmission elements include an input drive pinion gear 86 that is adapted to be driven by input drive shaft 35 in the manner which will be more fully described below, a reduction transfer gear 89, a crank gear 92, first, second and third drive linkages 94, 96, and 98 respectively and a drive lever 100. Transmission assembly 38 is further provided with a counterweight 101 carried by transmission housing 77. Counterweight 101 is specifically weighted and positioned to minimize vibrations developed during spin cycles of automatic washing machine 2 due to the considerable weight of transmission assembly 38 as will be described in more detail below.

Figure 3:
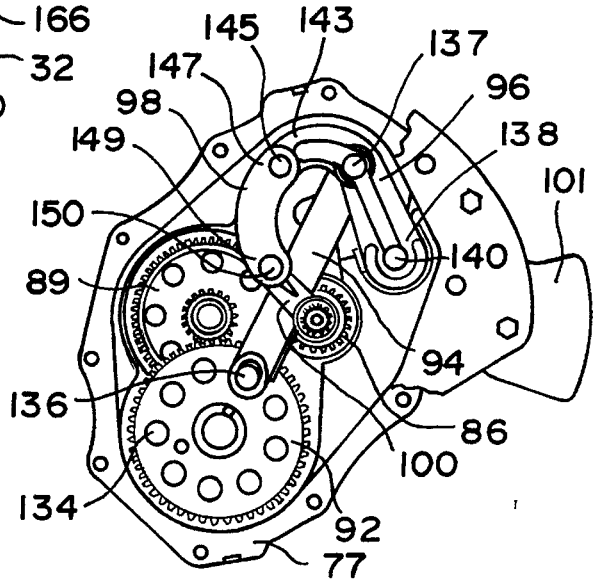
FIG. 3 is a top view of a transmission assembly forming part of the drive system of FIG. 2.
Figure 4:
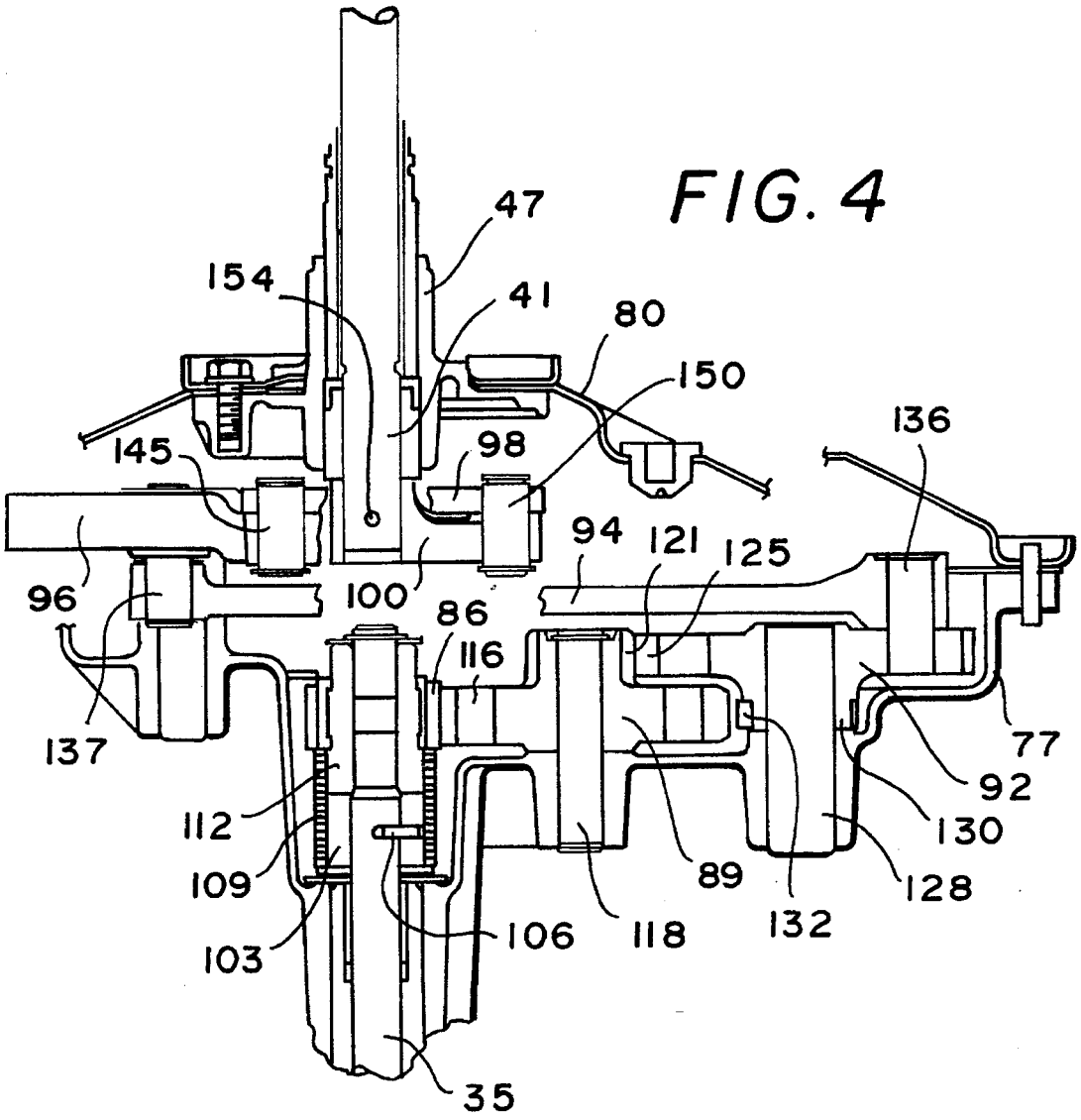
FIG. 4 is a partial schematic view of the transmission assembly incorporated in the drive system of FIG. 2.
Figure 5:
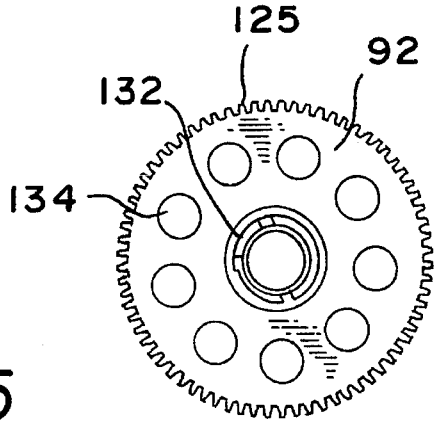
FIG. 5 is a bottom view of a crank gear incorporated in the transmission assembly of FIG. 4.

Reference will now be made to FIGS. 3–5 in describing the particular interconnections between the plurality of elements within transmission assembly 38. Input drive shaft 35 has secured thereto a drive hub 103 by means of a key 106. By this arrangement, rotation of input drive shaft 35 directly rotates drive hub 103. Rotation of drive hub 103 is transmitted through a wrap spring 109 to a collar member 112 that is fixedly secured to or integrally formed with input drive pinion gear 86. The particular manner in which wrap spring 109 functions to transmit drive from drive hub 103 to collar member 112 will be more fully described below in discussing the operation of drive assembly 22 during agitation and spin of automatic washing machine 2. Input drive pinion gear 86 directly meshes with a first toothed portion 116 of reduction transfer gear 89. Reduction transfer gear 89 is rotatably mounted within transmission housing 77 by means of a pin 118. Reduction transfer gear 89 further includes a second toothed portion 121 which directly meshes with a toothed portion 125 of crank gear 92. Crank gear 92 is rotatably mounted within transmission housing 77 by means of a pin 128. Reduction transfer gear 89 functions to step down the angular velocity of input drive pinion gear 86 while transmitting input drive to crank gear 92. Crank gear 92 has integrally formed therewith a hub portion 130 which has fixedly secured thereto or integrally formed therewith a cam member 132, the function of which will be detailed below.

Crank gear 92, as best shown in FIGS. 3 and 5, includes a plurality of circumferentially spaced apertures 134. A pin 136 is press fitted into one aperture 134, as seen in FIG. 4. First drive linkage 94 is drivingly connected to crank gear 92 by being slip fitted over pin 136 at one end and being secured to second linkage 96 by means of another pin 137 at its other end. Second linkage 96, in turn, includes one end 138 that is rotatably mounted about a fixed pivot axis defined by pin 140 and another end 143 which is pivotally interconnected by a pin 145 with a first end 147 of third drive linkage 98. As best shown in FIG. 3, first drive linkage 94 is interconnected by pin 137 to second drive linkage 96 intermediate first and second ends 138, 143 of second drive linkage 96. A second end 149 of third drive linkage 98 is pivotally interconnected with drive lever 100 by a pin 150. Drive lever 100, in turn, is pinned at 154 to output drive shaft 41. As previously stated, transmission housing 77 is fixedly secured to transmission housing sleeve member 47 which, in turn, is fixedly secured to basket hub 45.

Figure 2:
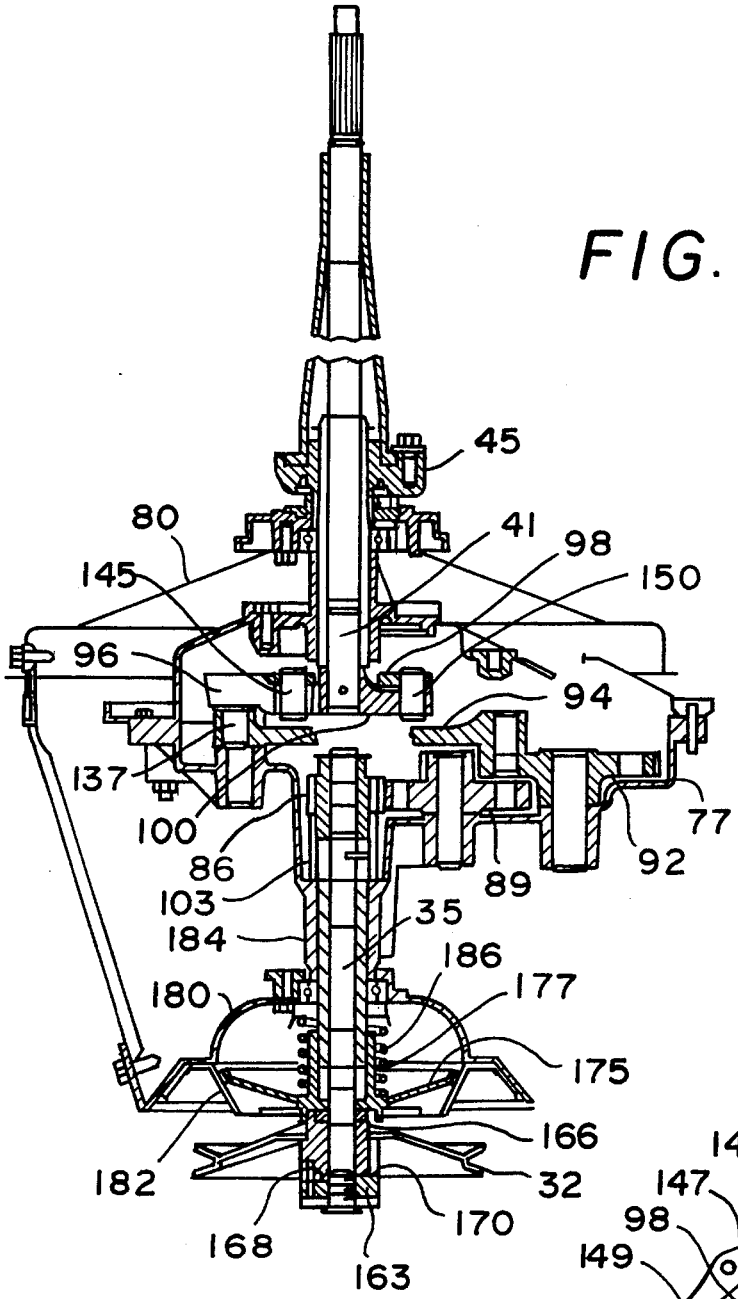
FIG. 2 Is a cross-sectional view depicting a portion of the drive system of the invention.
Figure 6A:
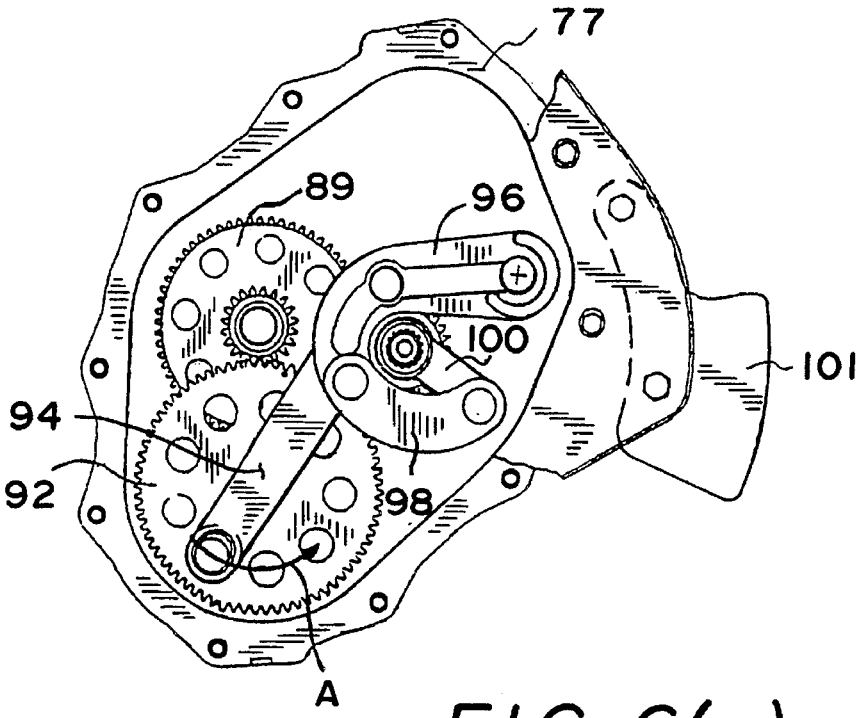
FIG. 6(*a*) is a top view of the transmission assembly of FIG. 4 depicting an operational state thereof during the agitation portion of a cycle of operation of the automatic washing machine.
Figure 6B:
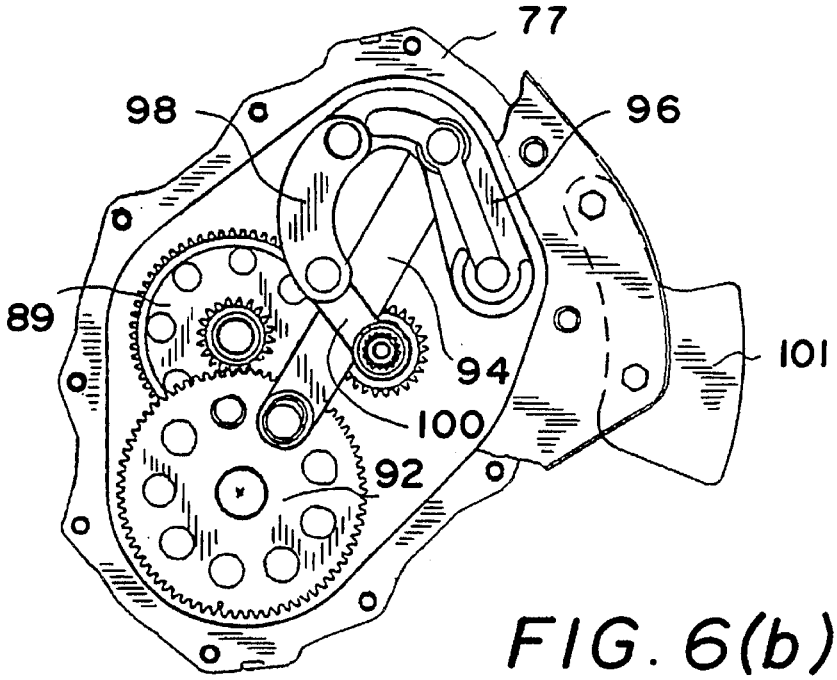

Reference will now be made to FIGS. 2, 6(*a*) and 6(*b*) in explaining the operation of drive assembly 22 during agitation portions of a cycle of operation of automatic washing machine 2. With initial reference to FIG. 2, input drive shaft 35 has mounted thereon a lower cam 163. Lower cam 163 cooperates with a hub portion 166 of second pulley 32 in order to transmit driving rotation from second pulley 32 to input drive shaft 35 through lower cam 163. Lower cam 163 defines a lower portion 168 and a higher portion 170. Hub portion 166 of second pulley 32 is actually rotatable relative to input drive shaft 35 and lower cam 163 by approximately 160°. Lower portion 168 and higher portion 170 of lower cam 163 are ramped, as is hub portion 166 of second pulley 32, such that the relative rotation of second pulley 32 and lower cam 163 functions to vertically shift second pulley 32 relative to input drive shaft 35 in dependence upon the input rotational direction from motor 25.

During agitation, motor 25 is driven such that second pulley 32 is rotated counterclockwise, i.e., into the page on the left side of FIG. 2. This counterclockwise rotation causes second pulley 32 to ramp down lower cam 163. After the 160° of relative rotation occurs, hub portion 166 will be positively engaged with lower cam 163 to drive input drive shaft 35. With second pulley 32 in this lower position, a brake rotor 175, concentrically mounted about input drive shaft 35 by means of a sleeve 177, will engage a brake drum 180. For this purpose, brake rotor 175 is provided with frictional padding 182. Sleeve 177, in turn, is splined to a sleeve 184 that is fixedly secured to transmission housing 77. Brake rotor 175 is biased into engagement with brake drum 180 by means of a coil spring 186. At this point, it should be noted that this drive configuration between second pulley 32 and input drive shaft 35 and the interconnection between sleeve 177 and transmission housing 77 are known in the art and the description thereof is only being provided for the sake of completeness.

When drive system 22 is driven in the counterclockwise direction, second pulley 32 and brake rotor 175 will assume the position shown in FIG. 2. As discussed above, this will result in second pulley 32 being located at a lowermost position with respect to input drive shaft 35 and frictional padding 182 will come into contact with brake drum 180. Brake drum 180 is fixedly secured to fixed housing 80 through legs such that transmission housing 77 is also fixed in this mode of operation. Therefore, second pulley 32 will drive input drive shaft 35 through lower cam 163 which, in turn, will directly rotate drive hub 103.

As best shown in FIG. 3, when drive hub 103 is rotated in the counterclockwise direction, wrap spring 109 will tighten so as to lock drive hub 103 and collar member 112 together. Therefore, input drive pinion gear 86 will be rotated. Rotation of input drive pinion gem 86 will cause rotation of reduction transfer gear 89 and crank gear 92 in the direction shown by arrow A in FIG. 6(*a*). Rotation of crank gear 92 will shift second and third drive linkages 96, 98 through first drive linkage 94. Movement of drive linkages 94, 96 and 98 will function to oscillate drive lever 100. This operation can best be understood from viewing FIGS. 6(*a*) and 6(*b*). In FIG. 6(*a*), drive lever 100 is positioned at one extreme end of oscillating motion. As crank gear 92 is rotated in the direction of arrow A, drive lever 100 will be rotated clockwise to the extreme position shown in FIG. 6(*b*). As crank gear 92 continues to rotate in the direction of arrow A, drive lever 100 will be rotated in the counterclockwise direction from the position shown in FIG. 6(*b*) to the position shown in FIG. 6(*a*). Continued rotation of crank gear 92 will therefore result in oscillation of drive lever 100. As previously stated, drive lever 100 is fixedly secured to output drive shaft 41 through pin 154 and output drive shaft 41 is spline connected to agitator unit 16. Therefore, oscillation of drive lever 100 results in oscillation of agitator unit 16.

Figure 7A:
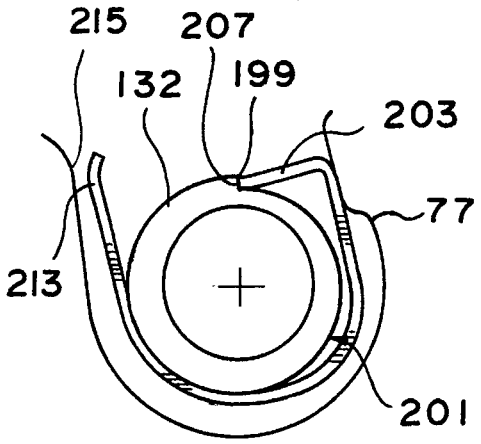
FIG. 7(*a*) shows a positioning assembly, according to a first embodiment of the invention, associated with an element of the transmission assembly in a spin operating mode.
Figure 7B:
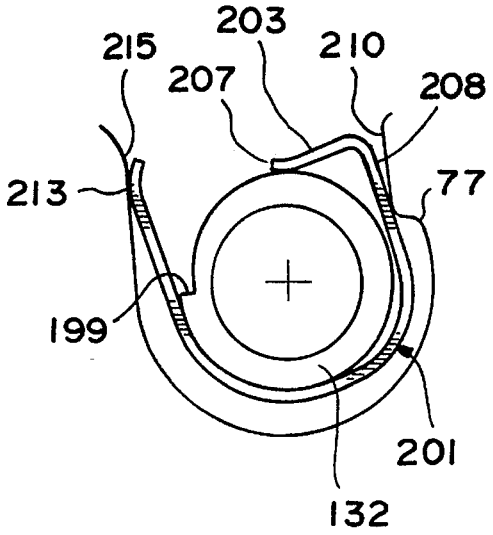
Figure 8A:
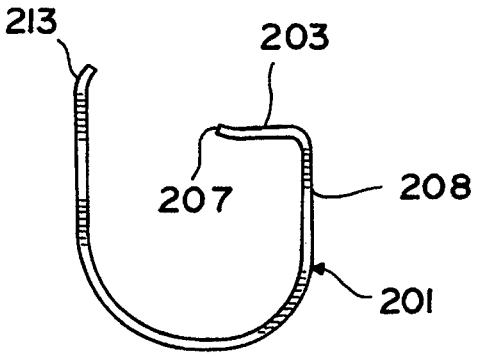
FIG. 8(*b*) is a side-view of the element shown in FIG. 8(*a*).
Figure 8B:
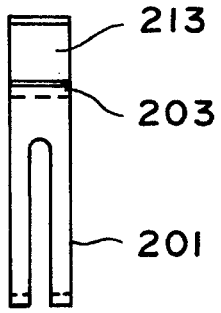

As discussed above with reference to FIGS. 4 and 5, crank gear 92 carries a cam member 132. A preferred embodiment of cam member 132 is shown in FIGS. 7(*a*) and 7(*b*). Cam member 132 defines an abutment surface 199 that is adapted to cooperate with a stop element which, in the embodiment shown in FIGS. 7(*a*) and 7(*b*), constitutes a spring clip 201. More specifically, spring clip 201 includes a first end portion 203 that terminates in a tip 207, an engagement surface portion 208 adapted to cooperate with a ledge 210 of transmission housing 77 as will be described more fully below, and a second end portion 213. As also will be described more fully below, second end portion 213 is adapted to engage a portion 215 of transmission housing 77. During agitation, cam member 132 rotates in the counterclockwise direction with crank gear 92 and spring clip 201 assumes a position shown in FIG. 7(*b*). In this position, second end portion 213 of spring clip 201 engages portion 2 15 of transmission housing 77. Rotation of crank gear 92 and cam member 132 in the counterclockwise direction is permitted since spring clip 201 is flexible and since abutment surface 199 will not engage tip 207 due to the rotational direction of cam member 132. Spring clip 201 is preferably sectioned adjacent to first end portion 203 as best shown in FIG. 8(*b*) to aid in its deflection. Therefore, once agitation has been initiated, spring clip 201 will be shifted to the position shown in FIG. 7(*b*) by initial rotation of cam member 132 and will remain in this position throughout the entire agitation period. While in this position, cam member 132 can rotate relative to spring clip 201 and transmission housing 77 with first end portion 203 of spring clip 201 flexing to accommodate the rotation of cam member 132.

During the spin portions of the cycle of operation of automatic washing machine 2, second pulley 32 is driven by motor 25 in the clockwise direction. Initially, as best illustrated in FIG. 2, second pulley 32 will rotate through 160° relative to lower cam 163. This relative rotation will cause second pulley 32 to be shifted upward relative to input drive shaft 35 due to the matched ramped surfaces of lower cam 63 and hub portion 166 of second pulley 32. This upward movement of second pulley 32 will cause hub portion 166 to engage sleeve 177 of brake rotor 175 thereby causing brake rotor 175 to shift upward against the biasing force of coil spring 186. Upward shifting of brake rotor 175 will disengage frictional padding 182 from brake drum 180 such that transmission housing 77 is no longer braked against rotation. Therefore, transmission housing 77 is left free to rotate relative to fixed housing 80. Once the relative 160° of rotation between second pulley 32 and lower cam 163 occurs, input drive shaft 35 will again be driven by second pulley 32 so as to cause drive hub 103 to be positively driven through key 106. Rotation of drive hub 103 will again cause collar member 112 to be rotated through wrap spring 109. In this drive direction, however, wrap spring 109 will slip and will only apply a given amount of torque to input drive pinion gear 86. As before, input drive pinion gear 86 will drive reduction transfer gear 89 and crank gear 92. Initial rotation of crank gear 92 will cause cam member 132 to rotate clockwise from the position shown in FIG. 7(*b*) to the position shown in FIG. 7(*a*). During this rotation, abutment surface 199 of cam member 132 will engage tip 207 of spring clip 201 and cause spring clip 201 to shift relative to transmission housing 77 until engagement surface 208 abuts ledge 210 of transmission housing 77. At this point, reduction transfer gear 89, crank gear 92, first, second and third drive linkages 94, 96 and 98, and drive lever 100 will be prevented from rotating relative to transmission housing 77. Instead, these elements will rotate in unison with transmission housing 77. Since transmission housing 77 is fixedly secured to basket hub 45 through transmission housing sleeve member 47, rotation of transmission housing 77 will directly result in rotation of washing basket 13. In addition, since drive lever 100 rotates in unison with transmission housing 77, output drive shaft 44 will also be rotated so as to cause agitator unit 16 to rotate in unison with washing basket 13.

As stated above, cam member 132 will assume the position shown in FIG. 7(*a*) with spring clip 201 abutting transmission housing 77 during spin. In the preferred embodiment, this will result in reduction transfer gear 89, crank gear 92, first, second and third drive linkages 94, 96 and 98 and drive lever 100 assuming the relative positions shown in FIGS. 3 and 6(*b*). Since the exact positioning of each of these transmission elements will be the same during each spin, counterweight 101 can be effectively positioned to counterbalance any vibrational effects that would be developed by rotation of these elements. With the drivetrain fixed with respect to transmission housing 77, the torque applied through wrap spring 109 will cause transmission housing 77, washing basket 13 and agitator unit 16 to come up to a desired spinning speed as the torque transmitted through wrap spring 109 overcomes inertia and frictional forces inherent in drive assembly 22. If there is a large unbalanced load in washing basket 13, wrap spring 109 will slip and the spin speed may not reach its maximum. This functions as a safety feature which protects automatic washing machine 2 from damage that might occur from spinning too large an imbalance at full speed. However, it should be noted that any imbalance of the system will result only from an imbalancing of the garments placed in washing basket 13 and not due to any vibrational effects developed by rotation of transmission assembly 38 due to the effective positioning of counterweight 101. Again, it should be emphasized that counterweight 101 can only be positioned to balance the rather heavy weight of the transmission elements in transmission assembly 38 since the exact positioning of these elements during any given spin is predetermined due to the presence of cam member 132 and its cooperation with the stop element.

When a spin portion of the cycle of operation is completed, motor 25 no longer drives second pulley 32 and transmission assembly 38 will overrun second pulley 32. When this occurs, second pulley 32 will again rotate back down its helical ramped surface engagement with lower cam 163. This allows brake rotor 175 to be forced back down into frictional engagement with brake drum 180, thereby applying a torque to transmission housing 77 so as to cause transmission housing 77 and washing basket 13 to stop.

Figure 9A:
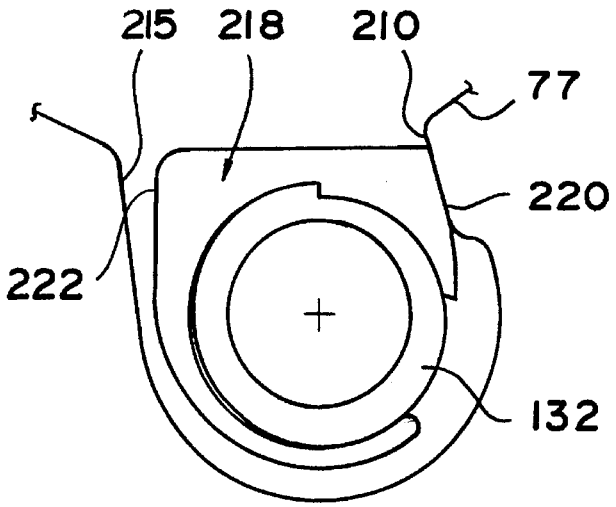
FIG. 9(*a*) depicts a positioning assembly, according to a second embodiment of the invention, positioned during spin.
Figure 9B:
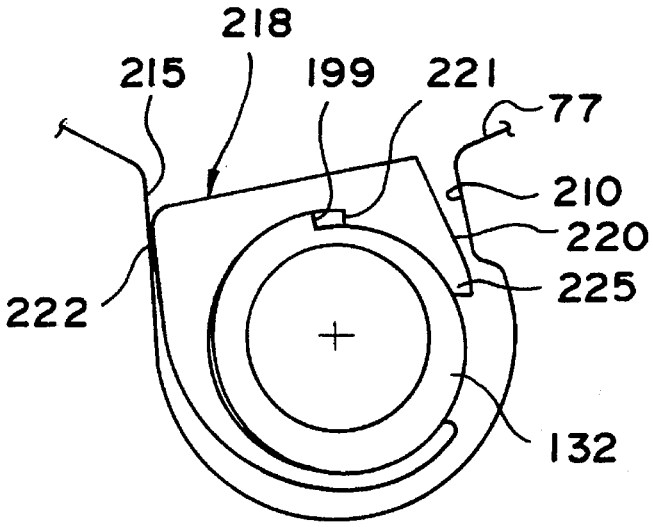

FIGS. 9(*a*) and 9(*b*) represent a second embodiment of the invention wherein the stop element that cooperates with cam member 132 is formed from a plastic collar member 218. FIGS. 9(*a*) and 9(*b*) correspond to the positions of cam member 132 and the stop element discussed above with references to FIGS. 7(*a*) and FIG. 7(*b*), respectively. In other words, when automatic washing machine 2 is in spin, cam member 132 will be rotated in the clockwise direction, as shown in FIGS. 9(*a*) and 9(*b*), until ledge 210 of transmission housing 77 is engaged by an engagement surface 220 of stop member 218. This engagement will, of course, be caused by the shifting of collar member 218 by cam member 132 with abutment surface 199 engaging wall portion 221 of collar member 218. During agitation, collar member 218 will assume the position shown in FIG. 9(*b*) wherein a wall surface 222 thereof will engage portion 215 of transmission housing 77. According to this embodiment, collar member 218 includes a tapered tip portion 225 that will periodically deflect upon rotation of cam member 132 during agitation in a manner directly analogous to spring clip 201 as discussed above. In all other respects, collar member 218 and spring clip 201 perform the same function which enables transmission assembly 38 to be accurately counterbalanced by counterweight 101.

Although described with respect to preferred embodiments of the invention, it should be readily understood that various changes and/or modifications may be made to the invention without departing from the spirit thereof. In general, the invention is only intended to be limited by the scope of the following claims.

I claim:

1. A drive system for producing spin and agitation in a cycle of operation of an automatic washing machine comprising:

an input drive member adapted to be rotatably driven about a first longitudinal axis of rotation;

an output drive member;

transmission means drivingly interposed between said input drive member and said an output drive member, said transmission means including a plurality of interengaged transmission elements, at least one of said transmission elements being adapted to rotate about a second longitudinal axis that is offset from said first longitudinal axis, said transmission means operating in a first mode wherein said transmission means is driven by said input drive member with said at least one transmission element rotating about said second longitudinal axis to oscillate said output drive member and produce agitation and in a second mode wherein said transmission means is driven by said input drive member with said at least one transmission element being fixed with respect to said second longitudinal axis to cause said output drive member to rotate and produce spin; and means for altering the operating mode of said transmission means, said altering means including a positioning assembly for automatically maintaining said plurality of transmission elements in a predetermined orientation by preventing rotation of said at least one transmission element about said second longitudinal axis whenever said transmission means is operating in said second mode.

2. The drive system of claim 1, wherein said positioning assembly is carried by said transmission means.

3. The drive system of claim 2, wherein at least a portion of said positioning assembly is carried by said at least one transmission element.

4. The drive system of claim 1, wherein said transmission means includes a housing within which said at least one transmission element is adapted to rotate about said at least one second longitudinal axis, said positioning assembly extending between said at least one transmission element and said housing.

5. The drive system of claim 4, wherein said positioning assembly comprises a cam member and a stop element, said cam member being carried by said at least one transmission element and said stop member being positioned between said cam member and said housing.

6. The drive system of claim 5, wherein said altering means includes an input drive unit providing bi-directional rotary drive to said input drive member wherein, when said input drive unit rotates said input drive member in a first rotational direction, said at least one transmission element is free to rotate about said second longitudinal axis to produce said agitation and when said input drive unit rotates said input drive member in an opposite rotational direction, said cam member engages said stop element to prevent rotation of said at least one transmission element about said second longitudinal axis.

7. The drive system of claim 6, wherein said stop element includes an engagement surface and is shiftable relative to said housing such that when said transmission means is operating in said first mode, the engagement surface of said stop element is spaced from said housing and when said second mode is initiated, said stop element is shifted by said cam member until said engagement surface abuts said housing to prevent rotation of said at least one transmission element about said second longitudinal axis.

8. A drive system for providing spin and agitation in a cycle of operation of an automatic washing machine comprising:

bi-directional rotary input drive means;

output drive means;

transmission means drivingly interposed between said input drive means and said output drive means, said transmission means including a plurality of interconnected drive elements located within a transmission housing; and means for converting one direction of rotary input drive from said input drive means to said transmission means into oscillating drive of said output drive means and converting the other direction of rotary input drive from said input drive means into uni-directional rotary output of said output drive means, said converting means including means for maintaining said plurality of interconnected drive elements in a predetermined orientation relative to said transmission housing whenever said input drive means is rotated in said other direction.

9. The drive system of claim 8, wherein said plurality of interconnected drive elements includes at least one gear adapted to rotate within said transmission housing, said maintaining means acting between said at least one gear and said transmission housing.

10. The drive system of claim 9, wherein said maintaining means comprises a cam member and a stop element, said cam member being carried by said at least one gear and said stop member being positioned between said cam member and said transmission housing.

11. The drive system of claim 10, wherein said cam member is integrally formed with said at least one gear.

12. The drive system of claim 10, wherein said stop element includes an engagement surface and is shiftable relative to said transmission housing such that whenever said input drive means is rotated in said one direction, the engagement surface of said stop element is spaced from said transmission housing in order to permit said at least one gear to rotate relative to said transmission housing and whenever said input drive means is rotated in said other direction, said cam member engages said stop element to forcibly shift the engagement surface of said stop element into abutment with said transmission housing to prevent rotation of said at least one gear relative to said transmission housing and to fix said plurality of interconnected drive elements in said predetermined orientation.

13. A method of providing spin and agitation in an automatic washing machine by driving an output shaft through a plurality of interconnected transmission elements located within a transmission housing of a transmission assembly which is driven by a hi-directional input drive unit comprising:

developing agitation by rotating the input drive unit in a first direction to drive the plurality of interconnected transmission elements of the transmission assembly, while fixing the transmission housing, to cause the output shaft to oscillate; and developing spin by rotating the input drive unit in a direction opposite to the first direction to initially, automatically lock the plurality of transmission elements in a consistent, predetermined orientation relative to the transmission housing and then rotating the entire transmission assembly in unison to cause the output shaft to rotate.

* * * * *